US007918664B2

(12) United States Patent
Leinemann

(10) Patent No.: US 7,918,664 B2
(45) Date of Patent: Apr. 5, 2011

(54) PERMANENTLY FIREPROOF FLAME GUARD

(75) Inventor: Christoph Leinemann, Braunschweig (DE)

(73) Assignee: Leinemann GmbH & Co. KG, Braunscheweig (DE)

( * ) Notice: Subject to any disclaimer, the term of this patent is extended or adjusted under 35 U.S.C. 154(b) by 418 days.

(21) Appl. No.: 10/559,761

(22) PCT Filed: Jun. 3, 2004

(86) PCT No.: PCT/DE2004/001155

§ 371 (c)(1),
(2), (4) Date: Dec. 7, 2005

(87) PCT Pub. No.: WO2004/108219

PCT Pub. Date: Dec. 16, 2004

(65) Prior Publication Data

US 2006/0144599 A1 Jul. 6, 2006

(30) Foreign Application Priority Data

Jun. 6, 2003 (DE) ..... 103 26 150

(51) Int. Cl.
*F23M 3/00* (2006.01)
*A62C 8/00* (2006.01)

(52) U.S. Cl. ..... 431/9; 169/48; 431/8; 239/552; 48/192

(58) Field of Classification Search ..... 169/45, 169/46, 48, 49, 54, 66; 122/17.1, 23, 24, 122/504, 18.31; 431/326, 328, 346, 354; 239/552

See application file for complete search history.

(56) References Cited

U.S. PATENT DOCUMENTS

| | | | | |
|---|---|---|---|---|
| 2,420,599 | A * | 5/1947 | Jurs | 48/192 |
| 3,227,241 | A | 1/1966 | Mattoon | |
| 3,748,111 | A * | 7/1973 | Klose | 48/192 |
| 4,909,730 | A * | 3/1990 | Roussakis et al. | 431/346 |
| 5,336,083 | A | 8/1994 | Rajewski | |
| 5,415,233 | A * | 5/1995 | Roussakis et al. | 169/48 |
| 5,588,822 | A | 12/1996 | Hayakawa et al. | |
| 5,752,812 | A | 5/1998 | Brown | |
| 6,179,608 | B1 * | 1/2001 | Kraemer et al. | 431/9 |
| 6,338,319 | B1 * | 1/2002 | Vago | 122/13.01 |
| 6,342,082 | B1 * | 1/2002 | Leinemann | 48/192 |
| 7,241,137 | B2 * | 7/2007 | Leinemann et al. | 431/346 |

FOREIGN PATENT DOCUMENTS

| | | |
|---|---|---|
| DE | 922756 | 1/1955 |
| DE | 1041423 | 4/1957 |
| FR | 1466440 | 12/1965 |
| GB | 2019718 | 11/1978 |

* cited by examiner

*Primary Examiner* — Dinh Q Nguyen
*Assistant Examiner* — James S Hogan
(74) *Attorney, Agent, or Firm* — Whitham Curtis Christofferson & Cook, PC

(57) ABSTRACT

A permanently fireproof flame guard includes a flow area (2) which terminates a conduit and within which an inserted flame shield is disposed. The flame shield is provided with a plurality of passage gaps that ensure permanent fire safety. Cooling of the permanently fireproof flame guard can be improved by forming at least one concentric, annular section (5) within the flow area (2) in a massive manner without passage gaps while forming annular sections (4) comprising passage gaps around the concentric, annular section (5).

12 Claims, 3 Drawing Sheets

PERMANENTLY FIREPROOF FLAME GUARD

Figure 1:
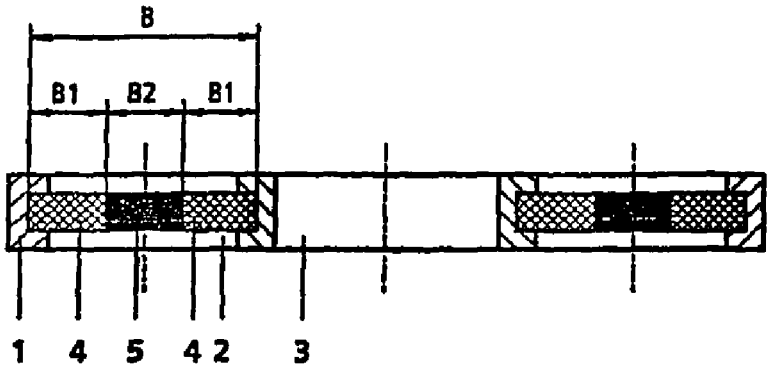

The invention relates to a permanently fireproof flame guard having a flow cross section that terminates a conduit, in which there is a flame guard insert having a large number of passage gaps ensuring that it is permanently fireproof.

Permanently fireproof flame guards of this type are used for ventilating installations at risk of explosion. They must be designed to be permanently fireproof in the event of the ignition of the gas or product vapor-air mixtures flowing out, that is to say to make it possible to flare off the mixtures over an unlimited time 5 period without it being possible for a flashback into the part of the installation to be protected to occur. A permanently fireproof flame guard of this type is known, for example from DE 1 041 423. In this case, the flow cross section is annular and encloses a hollow core piece, through which ambient air flows, which is taken in from the surroundings by the flame as the gas or vapor is flared off, and is used for cooling an annular grid serving as a flame guard. It has transpired that, in the case of a disk-like flame guard or in the case of an annular flame guard, the free area of the flame guard serving for the passage of the gas must not be too large, in order to avoid impermissibly high heating in the center of the flame guard, which could lead to a flashback. Therefore, disk-like flame guards can be used only up to a specific maximum diameter, and annular flame guards must not exceed a specific width of the ring. Therefore, when dimensioning the flame guard, there are difficulties in many cases, since the flame guard in each case has to be matched to the connection width of the conduit and, in the case of mixtures with a high ignition propagation capacity (explosion group IIB or IIC), in which very narrow flame extinguishing gaps are needed in the flame guard, the width or the inner and/or outer diameter of the flame guard has to be dimensioned in such a way that a desired through flow rate is achieved.

U.S. Pat. No. 5,336,083 discloses a detonation guard arrangement which is constructed from many parts. As viewed in the flow direction, it comprises a flame-extinguishing material which has a large number of passage gaps effecting the extinguishing of the flame. This material is formed by suitable bulk materials. On both sides of the flame extinguishing material in the flow direction there are detonation retarders in the form of plates stacked on one another which have slit-like interspaces, through which the flame front must pass in order to reach the flame-extinguishing material in the middle. In one variant of the detonation retarders, these do not comprise rectilinear plates but spirally wound strips, the slit-like interspaces needed for the gas passage being ensured by an interposed corrugated strip as a spacer. The detonation retarders have the function of intercepting the detonation front and dividing it up into individual detonation fronts. The detonation guard arrangement disclosed is not permanently fireproof but is designed to ensure safety against fire for only a limited time. This function is performed by the bulk material arranged in the middle and having the flame-extinguishing fine gaps, which material is distributed uniformly over the entire flow cross section.

The invention is based on the object of specifying a permanently fireproof flame guard in the form of a disk-like or annular flame guard with which heating of the flame guard, which threatens the permanent safety against fire, can be avoided in a straightforward manner.

In order to achieve this object, according to the invention a permanently fireproof flame guard of the type mentioned at the beginning is characterized in that, within the flow cross section, at least one concentric annular section is formed so as to be solid without the passage gap, around which annular sections having the passage gaps are formed.

The concentric section can be formed as an annular section and thus subdivide the flow cross section into a plurality of annular through flow areas. As an addition to this, a centrally arranged core can be provided.

The cross-sectional area of the flame guard insert with the passage gaps is expediently greater than the cross-sectional area without passage gaps. In a preferred embodiment of the invention, the area without passage gaps is between 35 and 40% of the total area of an annular flame guard and between 25 and 35% of the cross-sectional area of a disk flame guard.

The at least one concentric section provided according to the invention thus subdivides the area of the disk-like flame guard, by which means impermissible heating in the radial inner region of the flame guard is avoided. For this purpose, the at least one concentric section can be formed from a thermally insulating material, in order to delimit the region in which a flame forms on the area of the flame guard and to reduce heating in this region. However, it is also possible and preferred in many cases to form the concentric section of a highly thermally conductive material, in order to bring about an improved dissipation of heat in the concentric region within the flow cross section of the flame guard. For example, a centrally arranged core as a concentric section which is formed of highly thermally conductive material can effect an improved dissipation of heat in the center of the flow cross section and, for example, permit a disk-like flame guard to become a flame guard whose passage gaps are arranged on an annular surface.

In a particularly preferred embodiment of the invention, the concentric section can be formed from smooth metal strips wound spirally close together. This is particularly advantageous if the passage gaps of the flow-cross section are formed in a manner known per se by a corrugated metal strip wound together spirally with a smooth metal strip. Whilst maintaining the winding operation, in order to form a concentric section according to the invention, the supply of the corrugated metal strip to the winding apparatus can be stopped and only the smooth metal strip still be wound up until regularly, after a certain thickness of the concentric section formed in this way, the corrugated metal strip is again supplied with the smooth metal strip in order to form an outer annular section around the concentric section.

Figure 2:
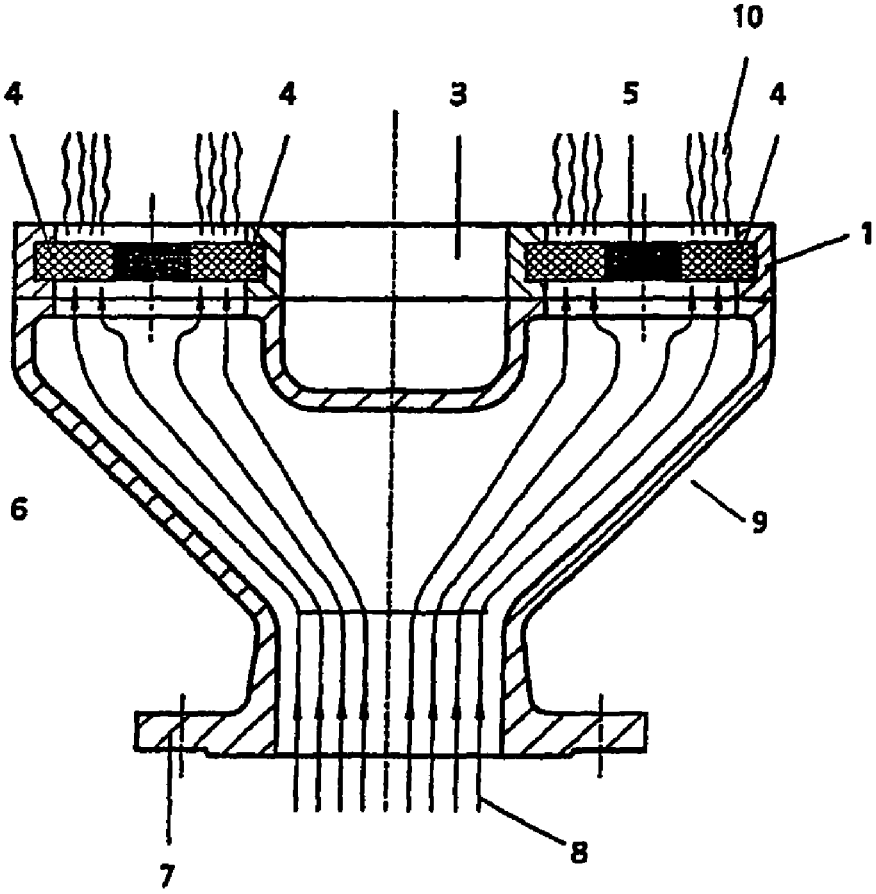
Figure 3:
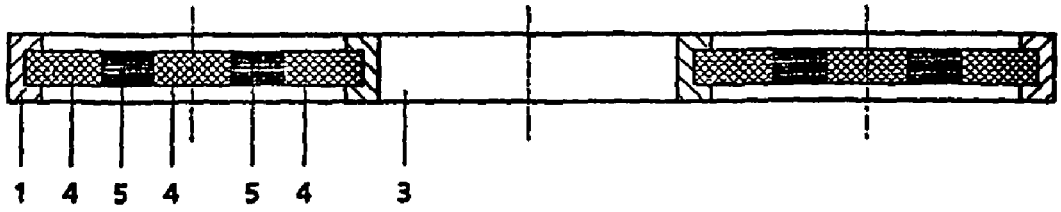
Figure 4:
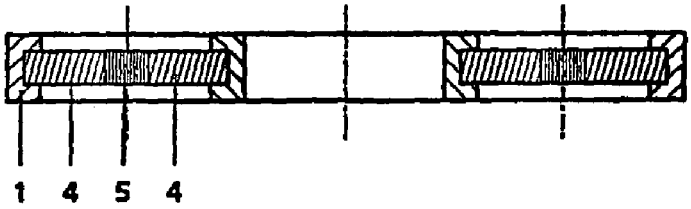
Figure 5:
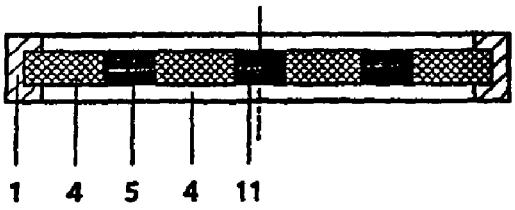
Figure 6:
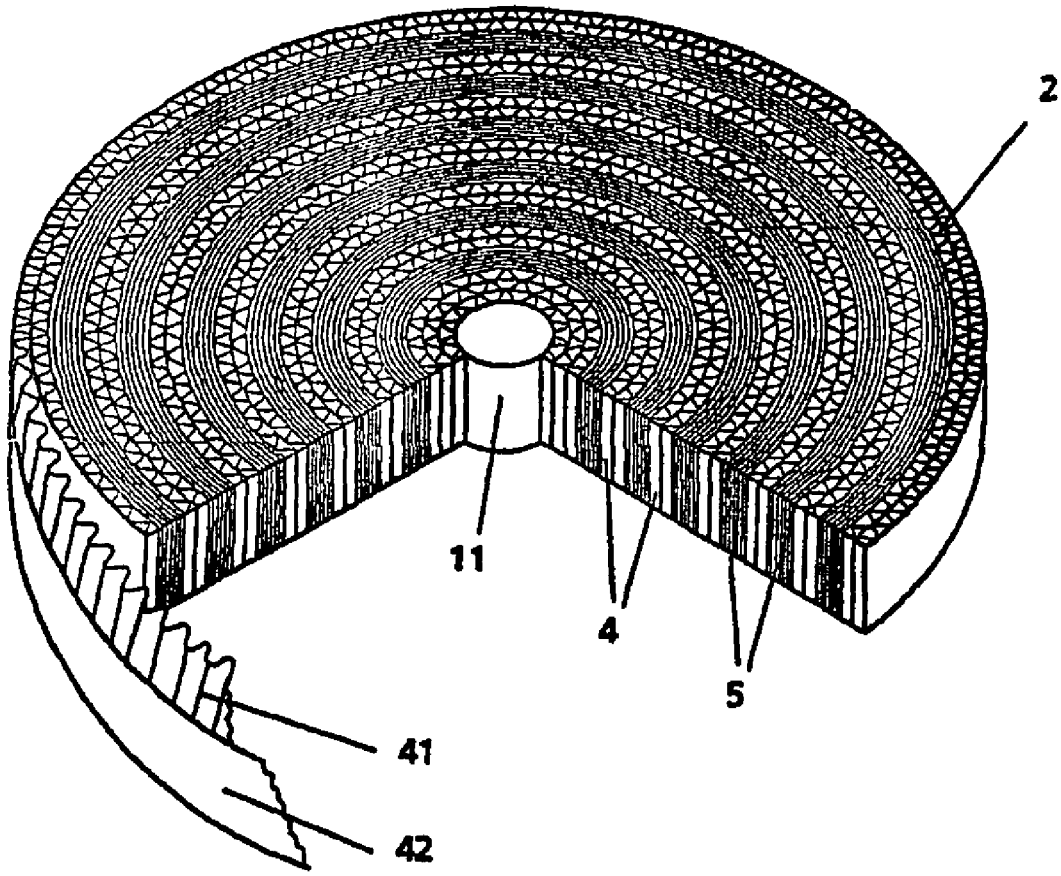

The invention is to be explained in more detail in the following text by using exemplary embodiments illustrated in the drawing, in which:

FIG. 1 shows a section through a first exemplary embodiment of an annular flame guard FIG. 2 shows the flame guard according to FIG. 1 as part of a valve FIG. 3 shows a section according to FIG. 1 through a second exemplary embodiment of a flame guard according to the invention FIG. 4 shows a flame guard according to FIG. 1 having a wound concentric section FIG. 5 shows a section through a disk-like flame guard formed in accordance with a further exemplary embodiment of the invention FIG. 6 shows a perspective, schematic, partly broken away illustration of a further embodiment of the invention, in which a plurality of concentric sections 5 are provided within a spiral winding of the flame guard.

FIG. 1 shows a first exemplary embodiment of a flame guard according to the invention, which is annular. Accordingly, a housing 1 is provided, which forms an annular enclosing cage for an annular flow cross section 2. A middle part 3 is left free by the housing 1.

Arranged in the flow cross section 2 are two annular flame guard arrangements 4, which are separated radially from each other by a concentric section 5. The flame guard arrangements 4 have passage gaps, while the concentric section 5 is formed without passage gaps and consists of a highly thermally conductive material, in particular metal.

The flame guard arrangements 4, together with the concentric section 5, form a flame guard insert 4, 5 having a width B. The radial width B2 of the concentric section 5, forming a cooling ring, is of approximately the same size as the equally sized widths B1 of the flame guard arrangements 4.

FIG. 2 shows a valve 6 which is equipped with the flame guard according to FIG. 1. The valve 6 has a connecting flange 7 for a conduit coming from a container or a corresponding connecting flange of a container. Gas flowing out of the container (which is also understood to include product vapors) flows in the direction of the flow arrows 8 illustrated in FIG. 2. The valve 6 has a housing 9 which widens in the form of a funnel and which is terminated by the housing 1 of the flame guard. The gas flows through the flame guard sections 4 and, after passing through the flame guard, can be burned by being ignited to form a flame 10 and therefore made non-damaging. The annular concentric section 5 effects delimitation of the annular areas of the flame guard sections 4 and, because of its solid construction without passage gaps, has the effect of good thermal dissipation, that is to say of cooling the flame guard sections 4. This prevents the flame guard sections heating up on the side pointing toward the housing 9 of the valve 6 to such an extent that the ignition temperature for the gas flowing out is reached.

In the second embodiment, illustrated in FIG. 3, three flame guard sections 4 are arranged concentrically in relation to one another and are divided radially from one another by two concentric sections 5 in annular form. In this way, a flame guard with a larger flow cross section can be implemented without having to incorporate the risk of excessive heating of the flame guard sections 4.

The concentric sections 5 illustrated in FIGS. 1 to 3 can be formed from solid metal, in order to effect good thermal dissipation. However, it must be ensured that no excessively large gap widths arise at the transition between the flame guard sections 4 and the concentric sections 5.

According to the exemplary embodiment indicated by FIG. 4, a simplification in the fabrication can be achieved by the flame guard sections 4—as known per se—being formed by a common spiral winding of a corrugated and a smooth metal strip in each case. The concentric section 5 can be made in a simple way by winding the smooth metal strip further which, thus wound close to itself without passage gaps, forms a concentric section 5 which is solid, so to speak, in the form of a cooling ring.

In the exemplary embodiment illustrated in FIG. 5, the housing 1 forms an enclosing cage for a disk-like flame guard, as can be used for smaller device dimensions. In a manner similar to that in the embodiment according to FIG. 1, two annular flame guard sections 4 are separated radially from each another by a concentric section 5 in the form of a ring. In addition, however, a further concentric section 11 in the form of a central core is provided, around which the radially inner flame guard section is formed annularly.

The heating of a disk-like flame guard, which is critical in particular toward the cross-sectional center, is thus prevented firstly by the annular concentric section 5 ("cooling ring") and secondly by the concentric section 11 arranged in the center ("cooling core").

FIG. 6 shows an exemplary embodiment of a spiral winding of a flame guard which is formed from a common winding of a corrugated metal strip 41 with a smooth metal strip 42. Formed inside the circular area of the flow cross section 2 are a plurality of annualar concentric sections 5, five such sections here, which are produced by the smooth metal strip 42 being wound up on its own, i.e. without the corrugated metal strip 41, in the regions of the concentric sections 5.

In the middle of the flow cross section 2 there is a concentric section 11 in the form of a central core, which is preferably a solid insert of a highly thermally conductive metal. Thus, in the flow cross section, adjacent to the concentric annular sections 5, in each case flame guard sections 4 are formed which have flow gaps whose areas are limited, so that excessive heating of the flame guard sections 4 can be avoided reliably.

The invention claimed is:

1. A permanently fireproof flame guard having a concentric flow cross section that terminates a conduit, in which there is a flame guard insert having a large number of flow passage gaps ensuring that it is permanently fireproof, wherein within the concentric flow cross section, at least one concentric solid annular section is formed so as to be solid without the passage gaps, and that on both sides of said at least one solid annular section there are annular concentric sections having the flow passage gaps, and wherein said at least one solid annular section subdivides the concentric flow cross section and is sufficiently sized to dissipate heat within the concentric flow cross section.

2. The permanently fireproof flame guard as claimed in claim 1, characterized in that the cross-sectional area of the flame guard insert with the flow passage gaps is greater than the cross-sectional area without flow passage gaps.

3. The permanently fireproof flame guard as claimed in claim 1, characterized in that a centrally arranged core is provided as a concentric section.

4. The permanently fireproof flame guard as claimed in claim 1, characterized in that at least one of the concentric section and the at least one solid annular section is formed of a highly thermally conductive material.

5. The permanently fireproof flame guard as claimed in claim 1, characterized in that, within the flow cross section, a plurality of solid annular sections are provided as concentric sections, which are in each case followed in the radial direction by annular sections with flow passage gaps.

6. The permanently fireproof flame guard as claimed in claim 1, characterized in that at least one of the concentric section and the at least one solid annular section is formed from a smooth metal strip wound spirally closely on itself.

7. The permanently fireproof flame guard as claimed in claim 6, characterized in that the flow passage gaps of the flow cross section are formed by a corrugated metal strip wound together spirally with a smooth metal strip.

8. The permanently fireproof flame guard as claimed in claim 1, characterized in that the flow cross section has an annular form.

9. A permanently fireproof flame guard having a concentric flow cross section that terminates a conduit, in which there is a flame guard insert having a plurality of flame guard sections arranged concentrically in relation to one another and divided radially from one another by concentric solid annular sections, each of the plurality of flame guard sections having a plurality of flow passage gaps ensuring that it is permanently fireproof, and within the flow cross section, the concentric solid annular sections are formed so as to be solid without the flow passage gaps, and that on both sides of each said solid annular concentric section there are annular sections having the flow passage gaps, wherein said concentric solid annular sections are metal, subdivide the flow cross section and are sufficiently sized to dissipate heat within the flow cross section.

10. The permanently fireproof flame guard as claimed in claim 9, wherein the flame guard sections comprise a spiral winding of a flame guard which is formed from a common winding of a corrugated metal strip with a smooth metal strip and solid annular sections are formed inside the circular area of the flow cross section by a plurality of annular concentric sections which are produced by the smooth metal strip being wound without the corrugated metal strip.

11. The permanently fireproof flame guard as claimed in claim 10, further comprising in the middle of the flow cross section a concentric section in the form of a central core, which is a solid insert of a highly thermally conductive metal, whereby in the flow cross section, adjacent to the concentric solid annular sections, in each case flame guard sections are formed which have flow gaps whose areas are limited, so that excessive heating of the flame guard sections can be avoided reliably.

12. The permanently fireproof flame guard as claimed in claim 1 wherein said flow cross section that terminates a conduit has a tapered configuration in cross-section.

* * * * *